US007841262B1

(12) United States Patent
Tsai

(10) Patent No.: US 7,841,262 B1
(45) Date of Patent: Nov. 30, 2010

(54) POSITIONING DEVICE FOR A HAND TOOL

(76) Inventor: Ming-Ching Tsai, 12F-4, No. 666, Sec. 2, Wuquan W. Rd., Nantun District, Taichung City (TW) 40878

( * ) Notice: Subject to any disclaimer, the term of this patent is extended or adjusted under 35 U.S.C. 154(b) by 0 days.

(21) Appl. No.: 12/476,220

(22) Filed: Jun. 1, 2009

(51) Int. Cl.
*B25B 23/16* (2006.01)
*B25G 1/06* (2006.01)

(52) U.S. Cl. ..... 81/177.9; 81/177.8; 81/177.7

(58) Field of Classification Search ..... 81/177.7, 81/177.8, 177.9
See application file for complete search history.

(56) References Cited

U.S. PATENT DOCUMENTS 207,709 A * 9/1878 Brett ..... 81/177.8
1,053,891 A * 2/1913 Steinke ..... 81/177.8
6,131,490 A * 10/2000 Lee ..... 81/177.9
6,216,567 B1 * 4/2001 Hu ..... 81/177.9
6,220,125 B1 * 4/2001 Lan ..... 81/177.9
2002/0092387 A1 * 7/2002 Lee ..... 81/177.8

* cited by examiner

*Primary Examiner*—Hadi Shakeri

(57) ABSTRACT

A positioning device for a hand tool includes a handle having a first connecting portion formed a chamber defined therein, a positioning member movably received in the chamber, and a tool head pivotally connected to the first connecting portion. The first connecting portion has a threaded hole. A rotatable plate has a threaded shank extended therefrom. The threaded shank passes through the threaded hole and abuts against the positioning member. The positioning member rigidly engages with the tool head. When the threaded shank is moved away from the positioning member, the tool head is available to be pivotally adjusted at a desired angle.

6 Claims, 5 Drawing Sheets

POSITIONING DEVICE FOR A HAND TOOL

BACKGROUND OF THE INVENTION

1. Field of the Invention

The present invention relates to a positioning device for a hand tool, and more particularly to a device for positioning a tool head of a hand tool at a desired angle.

2. Description of Related Art

A conventional pivot tip a hand tool in accordance with the prior art comprises a hand grasp member, an elongated member aligned with said hand grasp member, a work piece shaft mounted in relation to the elongated member for relative movement therewith between a retracted position and an extended position, and a pivot tip member between a first working position and a second working position. The pivot tip member is substantially normal to the longitudinal axis of the work piece shaft in the second working position. First holding means hold said work piece shaft in said extended position, and second holding means hold the pivot tip member in the first working position in axial alignment with the work piece shaft. Therefore, the pivot tip member includes a socket member and an axial bore passing through the socket member. The axial bore is axially aligned with the work piece shaft in the first working position or the second position. A tool is received in the axial bore for abutting against the work piece shaft when in the first working position or the second position.

However, the prior art suffers from several disadvantages. Due to the connecting structure between the pivot tip and the elongated shank, the work piece shaft has the relative retracting or extending movement. So the work piece shaft is broken easily if a strong force is applied. Moreover, the pivot tip a hand tool only has two work positions which are parallel and perpendicular to the hand grasp member. Therefore, the pivot tip a hand tool is inconvenient to be used.

The present invention has arisen to mitigate and/or obviate the disadvantages of the conventional hand tool.

SUMMARY OF THE INVENTION

The main objective of the present invention is to provide an improved positioning device for a hand tool.

To achieve the objective, the positioning device for a hand tool includes a handle having a first connecting portion and a tool head pivotally connected to the first connecting portion. The first connecting portion has a chamber defined therein and a threaded hole in communication with the chamber. A positioning member is movably received in the chamber. The positioning member includes a pusher having a plurality of first tooth formed thereatop and a spring abutting against the pusher. The pusher has a receiving space defined in the bottom thereof for receiving the spring. The tool head has a plurality of second tooth extended therefrom and toward the handle, and the second teeth rigidly engage with the first teeth for limiting the pivotal movement of the tool head. Furthermore a rotatable plate has a threaded shank extended therefrom. The threaded shank passes through the threaded hole for locking the pusher. When the rotatable plate is rotated, the threaded shank moves outwardly away from the pusher, and the pusher disengages with the tool head. Therefore, the tool head is available to be pivotally adjusted in a desired angle relative to the handle.

Further benefits and advantages of the present invention will become apparent after a careful reading of the detailed description with appropriate reference to the accompanying drawings.

DETAILED DESCRIPTION OF THE INVENTION

Figure 1:
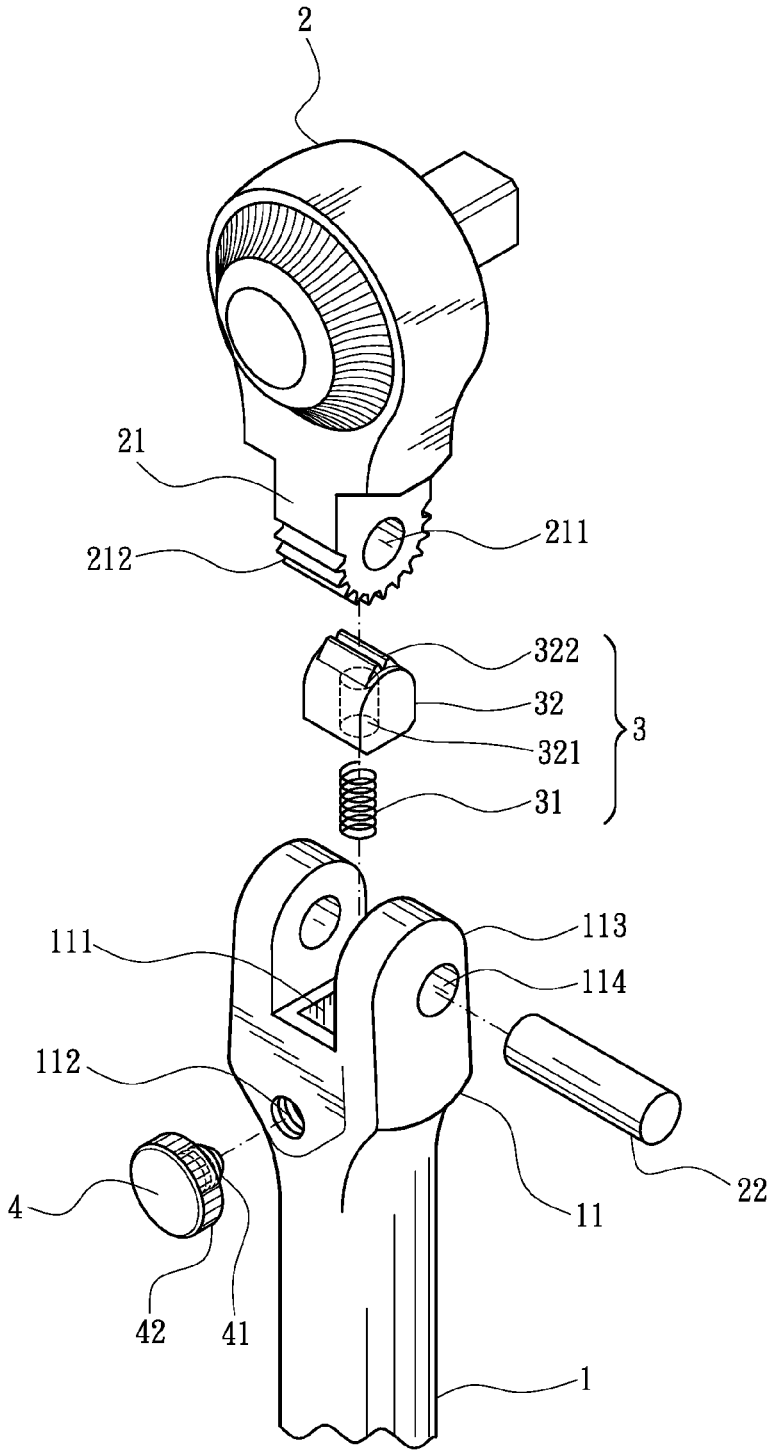
FIG. 1 is a perspective explosive view of a preferred embodiment of a positioning device for a hand tool.
Figure 2:
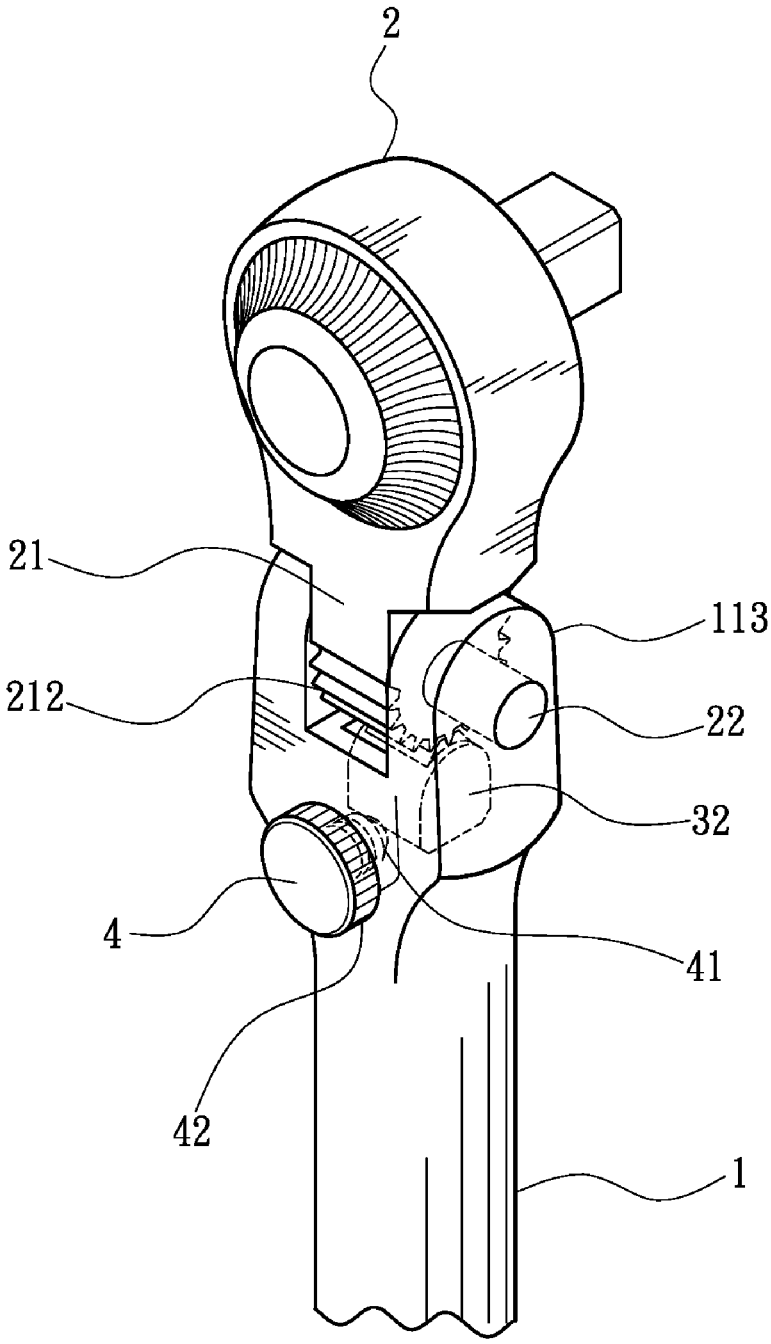
FIG. 2 is a perspective view of the preferred embodiment of the positioning device for a hand tool.

Referring to the drawings and initially to FIGS. 1-4, a positioning device for a hand tool in accordance with a preferred embodiment of the present invention comprises a handle 1 having a first connecting portion 11 formed one end thereof and a tool head 2 pivotally connected to the first connecting portion 11. The first connecting portion 11 of the handle 1 has a chamber 111 defined therein. The first connecting portion 11 has two ears 113 extended oppositely therefrom and extended toward the tool head 2. Each of the two ears 113 has a first through hole 114 defined in the lateral thereof. The two first through holes 114 are coaxially arranged. The first connecting portion 11 has a threaded hole 112 defined in the lateral thereof and communicated with the chamber 111.

A positioning member 3 is movably received in the chamber 111. The position member 3 comprises a pusher 32 having a receiving space 321 defined in the bottom thereof and a spring 31 compressibly received in the receiving space 321. The spring 31 has one end urging the pusher 32 toward the tool head 2 and the other end abutting against the bottom of the chamber 111. The pusher 32 has a plurality of first teeth 322 formed thereatop and extended toward the tool head 2. The pusher 32 has an inclined edge 323 formed on a bottom thereof and corresponding to the threaded hole 112 in position.

The tool head 2 has a second connecting portion 21 extended therefrom and mounted between the two ears 113. The second connecting portion 21 is configured into a semi-round shape on the bottom thereof. The second connecting portion 21 has a plurality of second teeth 212 extended peripherally on the bottom thereof and extended toward the pusher 32. The second teeth 212 selectively engage with the first teeth 322 on the pusher 32. The second connecting portion 21 has a second through hole 211 defined in the centre thereof and corresponding to the first through holes 114 in position. A pin 22 passes through the first through holes 114 and the second through hole 211 for pivotally connecting the tool head 2 with the handle 1.

The positioning device for a tool hand further includes a rotatable plate 4 configured into a round shape. The rotatable plate 4 forms a plurality of axial grooves 42 equally spaced on the circumference for increasing a rotating friction. The rotatable plate 4 has a threaded shank 41 extended in the centre therefrom. The threaded shank 41 is inwardly or outwardly screwed into the threaded hole 112. The threaded shank 41 has a conical end 411 correspondingly engaging with the inclined edge 323 on the pusher 32. Therefore, the pusher 32 received in the chamber 111 is locked rigidly by the inward movement of the threaded shank 41, and the pusher 32 is movable when the threaded shank 41 is moved outwardly.

Figure 3:
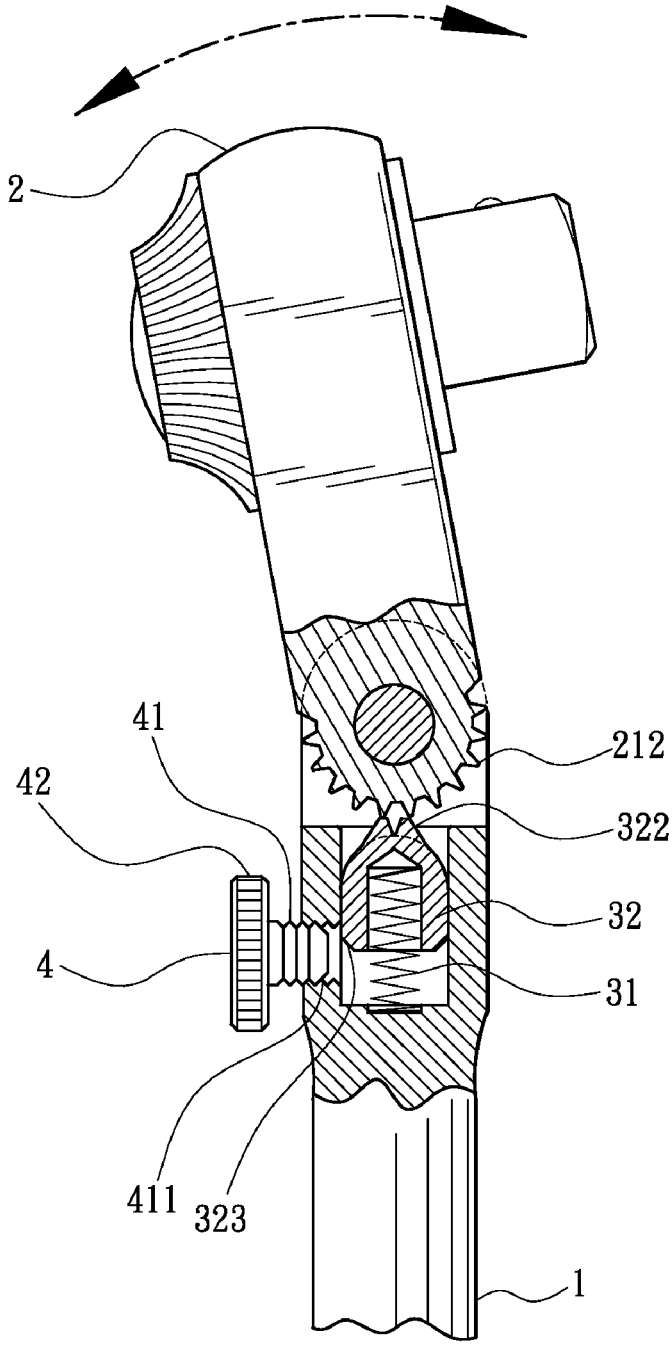
FIG. 3 is an operational partial cross-sectional view of the preferred embodiment of the positioning device for a hand tool as the threaded shank is moved outwardly and the tool head is pivotally rotatable.
Figure 4:
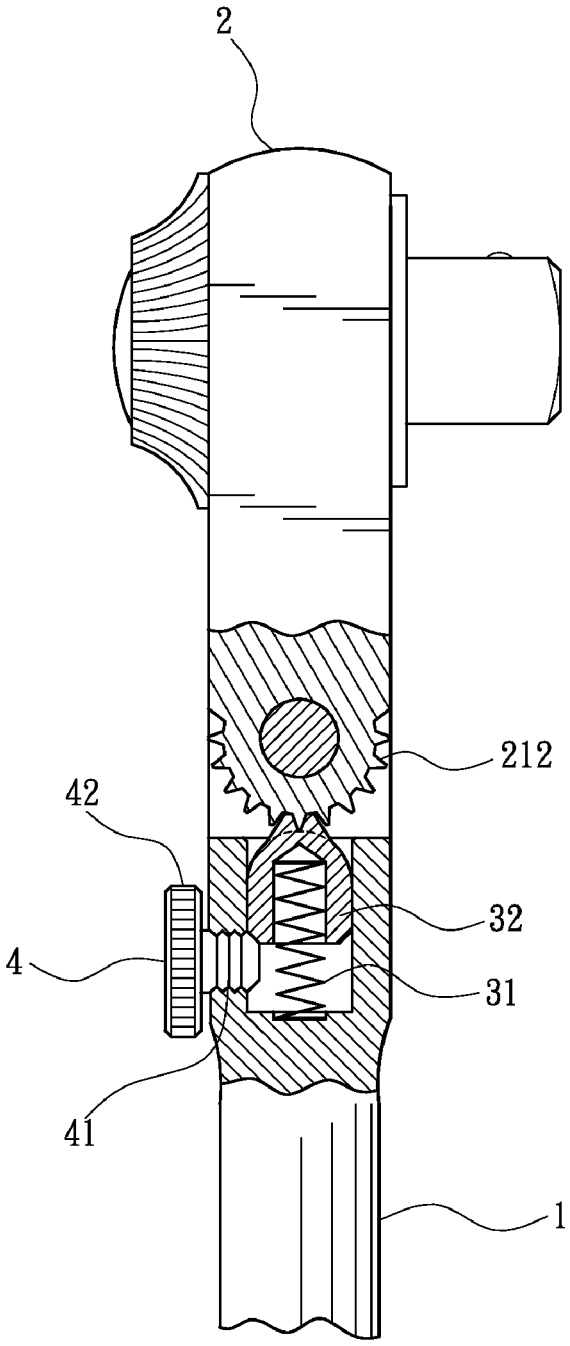
FIG. 4 is an operational partial cross-sectional view of the preferred embodiment of the positioning device for a hand tool as the threaded shank abuts against the pusher and the tool head is locked at a desired angle.

The operation of the positioning device for a hand tool in accordance with the present invention will be described in detailed below. As shown in FIGS. 3-4, the rotatable plate 4 is rotated, and thus the threaded shank 41 is moved outwardly away from the inclined edge 323 on the pusher 32 so that the first teeth 322 on the top of the pusher 32 disengage with the second teeth 212 of the tool head 2. Moreover, the spring 31 compressibly urges the pusher 32 toward the tool head 2. Therefore, when the tool head 2 is pivotally rotated in a desired angle relative to the handle 1, the pusher 32 is retracted by movement of the second teeth 212. When the first teeth 322 engages with the other second teeth 212 again, the first teeth 322 contacts with the second teeth 212 to make a sound for reminding a user of the number of passed teeth.

When the rotatable plate 4 is rotated reversely and thus the threaded shank 41 is moved inwardly to abut against the pusher 32. The first teeth 322 firmly engage with the second teeth 212. Therefore, the tool head 2 is locked in the desired angle relative to the handle 2 by the positioning member 3.

Figure 5:
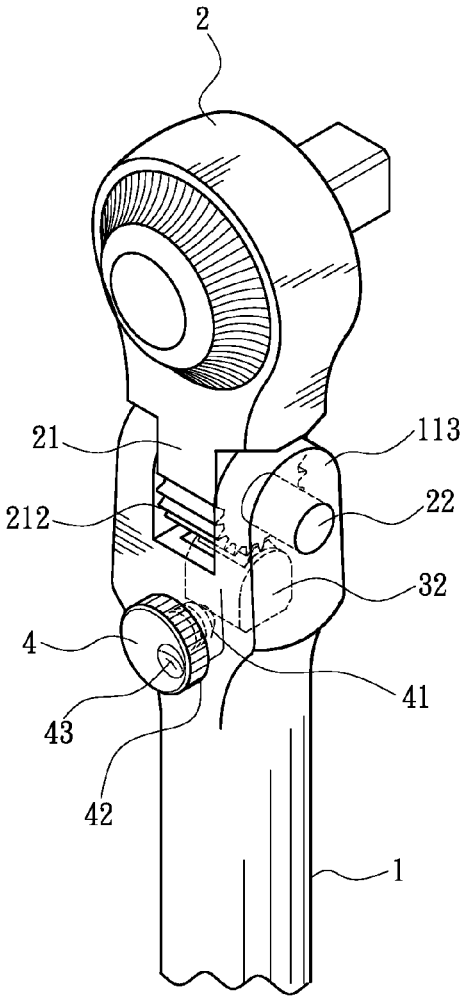
FIG. 5 is a perspective view of a second embodiment of the positioning device for a hand tool.

FIG. 5 shows a second embodiment of a positioning device for a hand tool according to the present invention. The elements and effects of the second embodiment which are the same with the preferred embodiment are not described, only the differences are described. The rotatable plate 4 has a dimple 43 defined eccentrically therein, so that a user is conveniently rotated the rotatable plate 4 by a finger.

Figure 6:
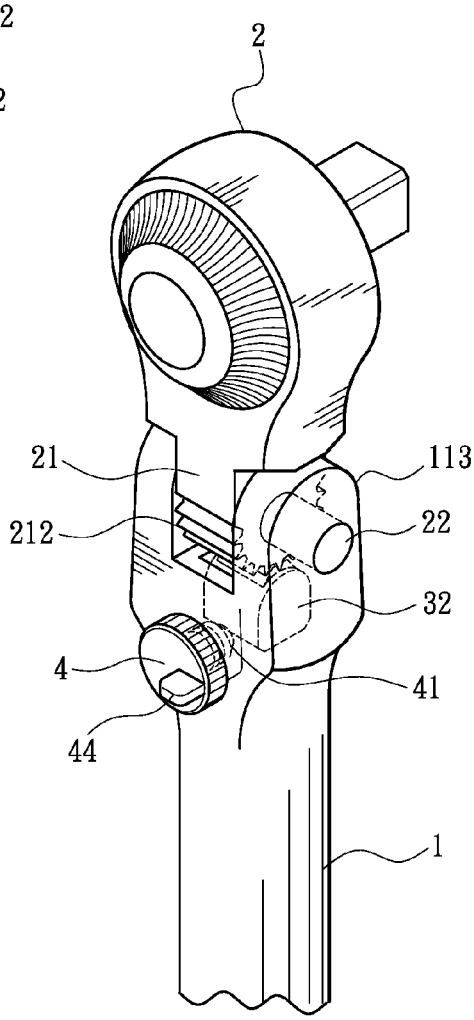
FIG. 6 is a perspective view of a third embodiment of the positioning device for a hand tool.

FIG. 6 shows a third embodiment of a positioning device for a hand tool according to the present invention. The elements and effects of the third embodiment which are the same with the preferred embodiment are not described, only the differences are described. The rotatable plate 4 has a knob 44 extended eccentrically therefrom. Thereby a user is conveniently rotated the rotatable plate 4 by a finger or two fingers.

Although the invention has been explained in relation to its preferred embodiment, it is to be understood that many other possible modifications and variations can be made without departing from the spirit and scope of the invention as hereinafter claimed.

What is claimed is:

1. A positioning device for a hand tool comprising:

a handle having a first connecting portion forming a chamber defined therein, the first connecting portion having a threaded hole in communication with the chamber;

a positioning member movably received in the chamber, the positioning member comprising a pusher having a plurality of first teeth formed thereatop and a spring abutting against the pusher, the usher having an inclined edge formed thereon;

a rotatable plate having a threaded shank extended therefrom, the threaded shank screwedly passing through the threaded hole for locking the pusher, the threaded shank having a conical end, the conical end of the threaded shank corresponding to the inclined edge of the pusher for rigidly engaging with the inclined edge of the pusher; and a tool head pivotally connected to the first connecting portion, the tool head having a plurality of second teeth extended therefrom and toward the handle, the second teeth rigidly engaging with the first teeth for limiting the pivotal movement of the tool head;

wherein when the rotatable plate is rotated, the threaded shank moves outwardly away from the pusher and the pusher disengages with the rotatable plate such that the tool head is available to be pivotally adjusted in a desired angle relative to the handle.

2. The positioning device for a hand tool as claimed in claim 1 further comprising a pin connecting the tool head with the handle, the first connecting portion having two ears extended oppositely therefrom, and each of the two ears having a first through hole defined in the lateral thereof, the tool head having a second connecting portion located between the two ears and forming a second through hole defined in the centre thereof and corresponding to the first through holes, wherein the pin passes through the first through holes and the second through hole.

3. The positioning device for a hand tool as claimed in claim 1, wherein the pusher has a receiving space defined in the bottom thereof for receiving the spring.

4. The positioning device for a hand tool as claimed in claim 1, wherein the rotatable plate is in a round shape and has a plurality of axial grooves equally spaced on the circumference so as to increase a rotating friction.

5. The positioning device for a hand tool as claimed in claim 1, wherein the rotatable plate has a dimple formed eccentrically therein so as to be conveniently rotated by a user.

6. The positioning device for a hand tool as claimed in claim 1, wherein the rotatable plate has a knob extended eccentrically therefrom so as to be conveniently rotated by a user.

* * * * *